US008306451B2

(12) United States Patent
Yomoda et al.

(10) Patent No.: US 8,306,451 B2
(45) Date of Patent: Nov. 6, 2012

(54) DEVELOPER SUPPLY CONTAINER FEATURING TWO DEVELOPER ACCOMMODATING CHAMBERS

(75) Inventors: Nobuyuki Yomoda, Toride (JP); Katsuya Murakami, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 428 days.

(21) Appl. No.: 12/629,968

(22) Filed: Dec. 3, 2009

(65) Prior Publication Data

US 2010/0150605 A1 Jun. 17, 2010

(30) Foreign Application Priority Data

Dec. 17, 2008 (JP) ..... 2008-321638

(51) Int. Cl.
*G03G 15/08* (2006.01)

(52) U.S. Cl. ..... 399/106; 399/262

(58) Field of Classification Search ..... 399/262, 399/260, 106; 220/501, 500, 529, 502; 222/DIG. 1, 222/167, 169–171, 325, 367, 368, 333, 129; 141/364, 365, 361, 346, 348; 137/630.19, 137/630.22, 614.11
See application file for complete search history.

(56) References Cited

U.S. PATENT DOCUMENTS

| | | | | |
|---|---|---|---|---|
| 5,915,155 | A * | 6/1999 | Shoji et al. | 399/262 |
| 6,493,516 | B2 | 12/2002 | Murakami et al. | |
| 6,879,789 | B2 | 4/2005 | Yamada et al. | |
| 6,920,298 | B2 | 7/2005 | Yamada et al. | |
| 6,990,301 | B2 | 1/2006 | Yamada et al. | |
| 7,127,193 | B2 | 10/2006 | Yamada et al. | |
| 7,324,777 | B2 | 1/2008 | Yamada et al. | |
| 7,376,369 | B2 | 5/2008 | Yamada et al. | |
| 7,382,997 | B2 | 6/2008 | Yamada et al. | |
| 7,386,251 | B2 | 6/2008 | Yamada et al. | |
| 7,430,384 | B2 | 9/2008 | Yamada et al. | |
| 7,433,633 | B2 | 10/2008 | Yamada et al. | |
| 7,469,113 | B2 | 12/2008 | Yamada et al. | |
| 7,647,012 | B2 | 1/2010 | Yamada et al. | |
| 2007/0104505 | A1 | 5/2007 | Murakami et al. | |
| 2008/0019730 | A1 * | 1/2008 | Yoon et al. | 399/106 |
| 2008/0298835 | A1 | 12/2008 | Takashima | |
| 2010/0284710 | A1 * | 11/2010 | Sasaki et al. | 399/262 |

FOREIGN PATENT DOCUMENTS

| | | | |
|---|---|---|---|
| CN | 101315539 | A | 12/2008 |
| JP | 8-286483 | A | 11/1996 |
| JP | 08286483 | A * | 11/1996 |

OTHER PUBLICATIONS

Notification of First Office Action dated Nov. 30, 2011, in Chinese Application No. 200910252763.4.

* cited by examiner

*Primary Examiner* — Susan Lee
(74) *Attorney, Agent, or Firm* — Fitzpatrick, Cella, Harper & Scinto

(57) ABSTRACT

A developer supply container detachably mountable to an image forming apparatus includes a first chamber, provided with a first opening, for accommodating a developer; a second chamber for receiving the developer from the first chamber through the first opening, the second chamber being provided with a second opening for permitting discharge of the developer to an outside of the developer supply container; a first sealing member for sealing the first opening; a second sealing member for sealing the second opening; and a connecting mechanism for interrelating an unsealing operation of the first opening with an unsealing operation of the second opening, while permitting a resealing operation of the second opening by said second sealing member without resealing the first opening by the first sealing member.

14 Claims, 13 Drawing Sheets

(a)

(b)

(c)

(a)

(b)

(c)

(a)

(b)

(c)

(a)

(b)

(c)

DEVELOPER SUPPLY CONTAINER FEATURING TWO DEVELOPER ACCOMMODATING CHAMBERS

FIELD OF THE INVENTION AND RELATED ART

The present invention relates to a developer supply container for supplying a developer to an image forming apparatus of an electrophotographic type such as a copying machine or a printer.

In the electrophotographic image forming apparatus such as the electrophotographic copying machine or the electrophotographic printer, the developer in the form of fine powder has been conventionally used. In the case where the developer in a main assembly of the electrophotographic image forming apparatus is consumed, the developer is supplied to the image forming apparatus main assembly by using the developer supply container. Here, a method in which the developer supply container is mounted inside the image forming apparatus main assembly so that the developer does not scatter during the supply of the developer, thereby to discharge the developer little by little through a small opening has been proposed and put into practical use.

The developer supply container is described in, e.g., Japanese Laid-Open Patent Application (JP-A) Hei 8-286483, in which a constitution for solving a problem that the developer cannot be supplied to the image forming apparatus due to an occurrence of such a phenomenon that a large amount of the developer concentrates at the opening to block the opening is employed. Specifically, in this constitution, an empty container portion is provided adjacent to a developer accommodating portion and the developer to be discharged is supplied to the image forming apparatus through the empty container portion. By this constitution, the developer discharged in the large amount is temporarily stored in the empty container portion and thereafter a certain amount of the developer is supplied to the image forming apparatus, so that the opening is prevented from being blocked with the developer. In this constitution, a communication opening for supplying the developer from the developer accommodating portion to the empty container portion and a discharge opening for permitting discharge of the developer from the empty container portion to the apparatus main assembly are provided. Further, a communication opening sealing member for sealing the communication opening and a discharge opening sealing member for sealing the discharge opening are integrally constituted so as to be movable to together.

However, in the constitution of the developer supply container described in JP-A Hei 8-286483, there was a possibility of an occurrence of the following problem.

In the case where the developer supply container is exchanged for a fresh container at the time before the developer is used up during printing on a large amount of sheets or in the case where a user unnecessarily demounts the container at the time before the developer is used up, the container can be demounted in midstream.

In the constitution described in JP-A Hei 8-286483, when the container is demounted in midstream, the communication opening sealing member integrally constituted with the discharge opening sealing member is to be moved toward a sealing position thereof in interrelation with movement of the discharge opening sealing member toward a sealing position of the discharge opening sealing member. At that time, a large amount of the developer remains in the developer supply container, so that the large amount of the developer is present also in the neighborhood of the communication opening.

Therefore, when the communication opening sealing member is moved toward the position in which the communication opening sealing member seals the communication opening, the movement of the communication opening sealing member is prevented by the developer present in the neighborhood of the communication opening, so that the communication opening sealing member cannot move to its sealing position.

As a result, the discharge opening sealing member integrally constituted with the communication opening sealing member also cannot move to its sealing position. Thus, there was a possibility of an occurrence of improper sealing (sealing defect). As a result, the container was demounted in a state in which the discharge opening was not sealed, so that there was a possibility that the image forming apparatus main assembly and its periphery were contaminated with the developer.

SUMMARY OF THE INVENTION

A principal object of the present invention is to provide a developer supply container from a possibility of an occurrence of improper sealing.

According to an aspect of the present invention, there is provided a developer supply container detachably mountable to an image forming apparatus, comprising:

a first chamber, provided with a first opening, for accommodating a developer;

a second chamber for receiving the developer from the first chamber through the first opening, the second chamber being provided with a second opening for permitting discharge of the developer to an outside of the developer supply container;

a first sealing member for sealing the first opening;

a second sealing member for sealing the second opening; and a connecting mechanism for interrelating an unsealing operation of the first opening with an unsealing operation of the second opening, while permitting a resealing operation of the second opening by said second sealing member without resealing the first opening by the first sealing member.

According to another aspect of the present invention, there is provided a developer supply container detachably mountable to an image forming apparatus including a locking member, the developer supply container comprising:

a first chamber, provided with a first opening, for accommodating a developer;

a second chamber, provided with a second opening for permitting discharge of the developer to an outside of the developer supply container, for receiving the developer from the first chamber through the first opening;

a first sealing member for sealing the first opening;

a second sealing member for sealing the second opening;

a locking portion, provided engageably with the locking member, for receiving from the locking member a force for unsealing the second opening; and an interrelating mechanism for interrelating an unsealing operation of the first opening with an unsealing operation of the second opening performed by the force received by the locking portion;

wherein the interrelating mechanism interrelating the unsealing operations of the first and second openings with each other so that the first opening is unsealed after the second opening is unsealed.

According to a further aspect of the present invention, there is provided a developer supply container detachably mountable to an image forming apparatus including a locking member, the developer supply container comprising:

a first chamber, provided with a first opening, for accommodating a developer;

a second chamber for receiving the developer from the first chamber through the first opening wherein the second chamber is provided with a second opening for permitting discharge of the developer to an outside of the developer supply container, and includes a feeding pipe for feeding the developer toward the second opening by rotation of the second chamber;

a first sealing member for sealing the first opening so that the developer does not enter the feeding pipe; and a second sealing member for sealing the second opening, the second sealing member being capable of resealing the second opening.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, embodiments of the developer supply container according to the present invention will be described based on embodiments with reference to the drawings. In the following description, unless otherwise specified, various constitutions of the developer supply container of the present invention can be replaced with known constitutions having the same functions within the scope of the present invention. That is, unless otherwise specified, the present invention is not limited to the constitutions of the developer supply containers described in the following embodiments.

Embodiment 1

First, with reference to FIGS. 1 and 2, a constitution of an electrophotographic copying machine as an example of an image forming apparatus of an electrophotographic in which the developer supply container according to the present invention is mounted will be described.

(Image Forming Apparatus)

Figure 1:
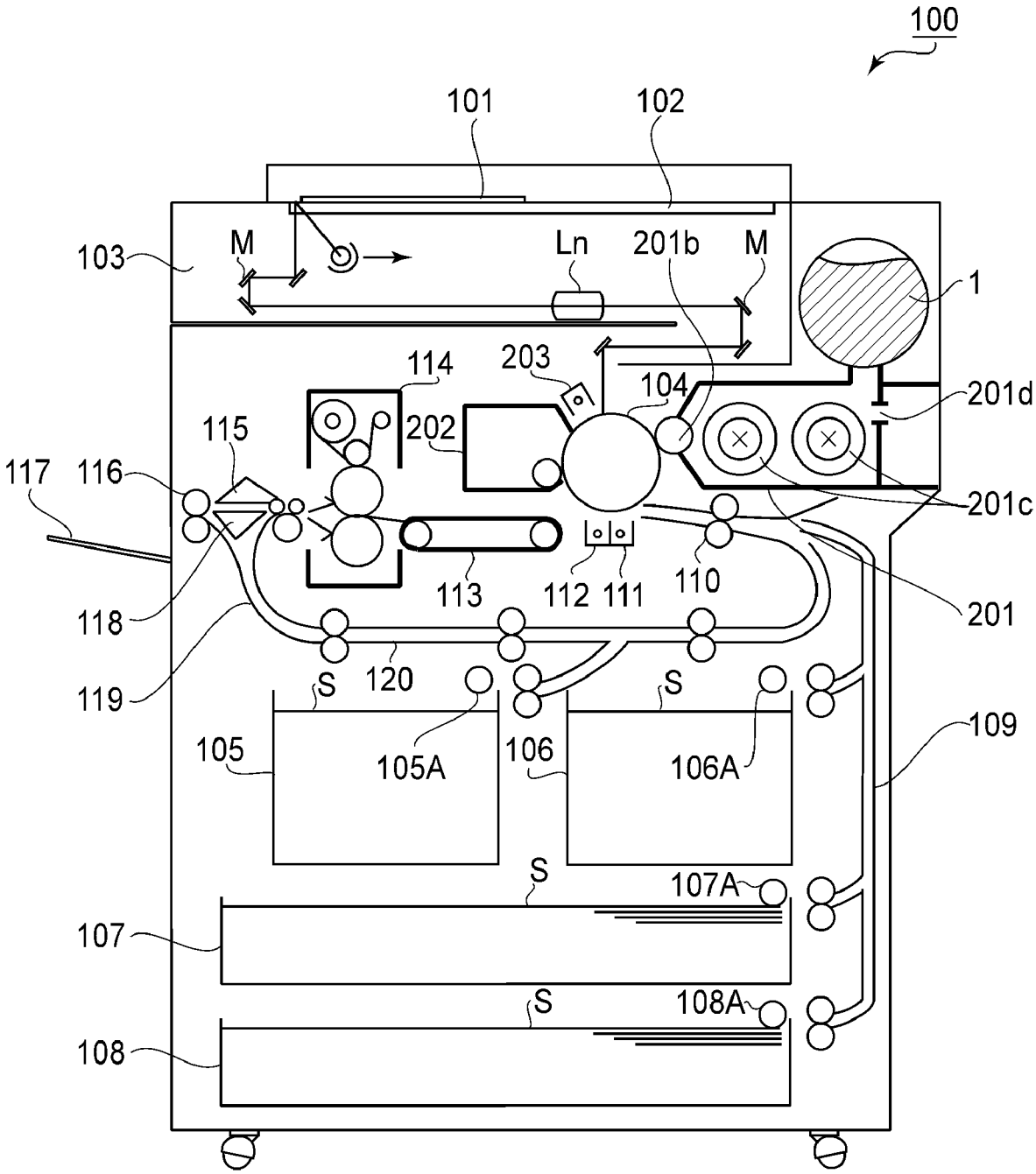
FIG. 1 is a schematic longitudinal sectional view of an image forming apparatus (copying machine).
Figure 2:
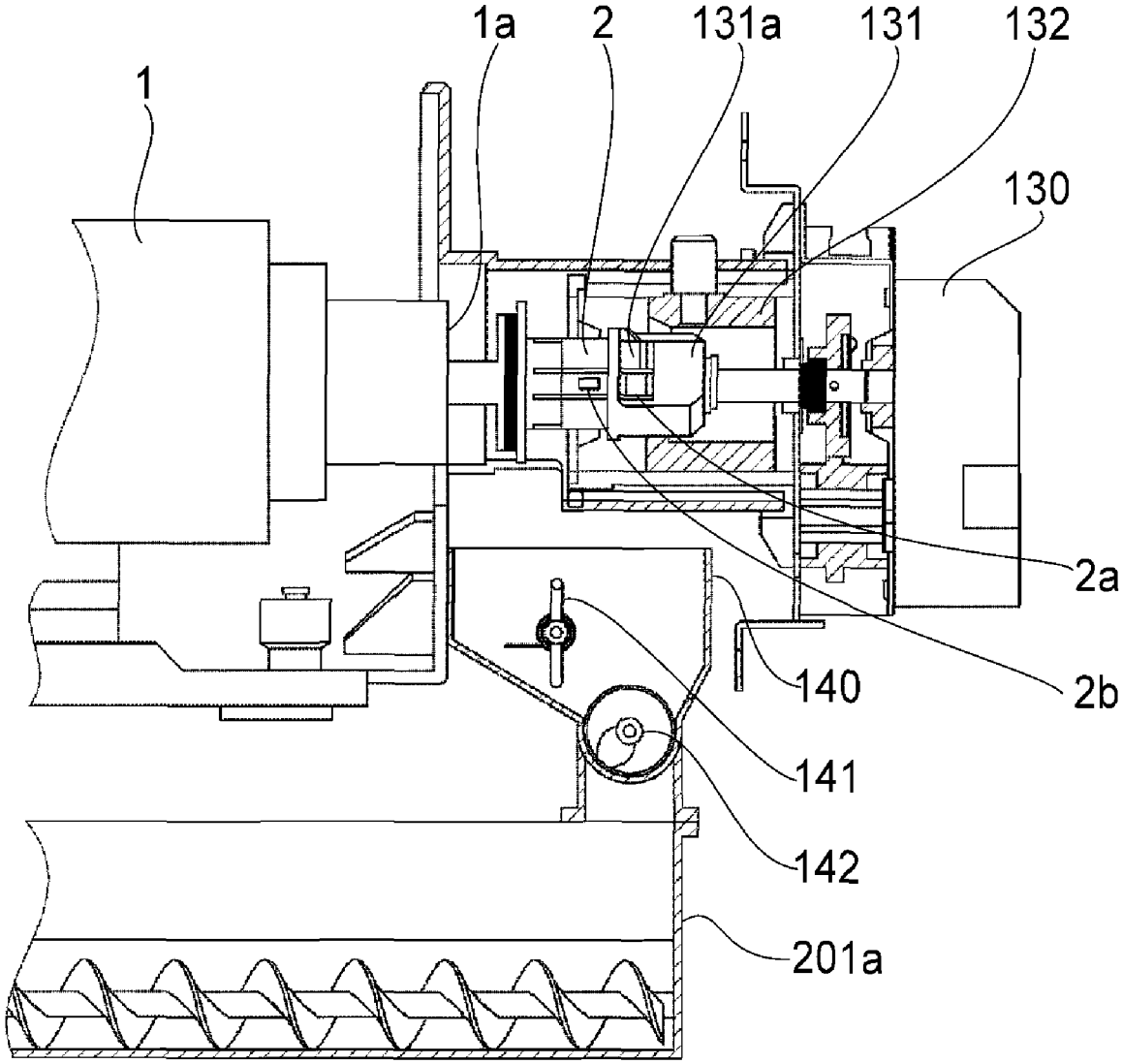
FIG. 2 is a schematic view showing a constitution of a developer receiving device (developer supplying device).

With reference to FIG. 1, the constitution of the copying machine employing the electrophotographic method in which the developer supply container (the so-called toner cartridge) is configured to be detachably mountable to a developer receiving device in a main assembly of the image forming apparatus.

In the figure, a reference numeral 100 represents the image forming apparatus main assembly (hereinafter referred to as an "apparatus main assembly 100"). A reference numeral 101 represents an original, which is placed on an original supporting platen glass 102. An electrostatic latent image is formed on an electrophotographic photosensitive member 104 (hereinafter referred to as a "photosensitive drum") as an image bearing member by focusing an optical image, which is based on image information on the photosensitive drum with the use of a plurality of mirrors M and a lens Ln of an optical portion 103. This electrostatic latent image is visualized (developed) with a developer by a developing device 201.

Incidentally, in this embodiment, the developer which contains toner and a carrier is used. Therefore, in a developer supply container 1 described later, both of the toner and the carrier are accommodated.

Reference numerals 105 to 108 represent cassettes for accommodating a recording material (medium) S (hereinafter referred to as a "sheet"). With respect to these sheets S stacked in the cassettes 105 to 108, an optimum cassette is selected based on information input by an operator (user) through a liquid crystal operating portion of the copying apparatus or based on the sheet size of the original 101. The recording material is not limited to a sheet of paper but, for example, an OHP sheet and the like can appropriately be used and selected.

A sheet fed by an associated one of sheet feeding and separating apparatuses 105A to 108A is conveyed to registration rollers 110 by way of a conveying portion 109 and then is conveyed further in synchronism with rotation of the photosensitive drum 104 and scanning timing of the optical portion 103.

Reference numeral 111 and 112 represent a transfer discharging device and a separation discharging device, respectively. The image formed of the developer on the photosensitive drum 104 is transferred onto the sheet S by the transfer discharging device 111. The sheet S on which the developer image has been transferred is separated from the photosensitive drum 104 by the separation discharging device 112.

Thereafter, the sheet S is conveyed further by a conveying portion 113 to a fixing portion 114. In the fixing portion 114, the developer image on the sheet S is fixed by heat and pressure. In the one-side copying mode, the sheet S is conveyed through a discharging and turning portion 115 and then is discharged onto a discharge tray 117 by discharging rollers 116. In the superimposed copy mode, the sheet S is conveyed to the registration rollers 110, by way of re-feeding and conveying portions 119 and 120, by being controlled by a flapper 118 of the discharge and turning portion 115. Then, the sheet S is discharged onto the discharge tray 117 through the same path as that in the case of the one-side copy mode.

In the both-side copy mode, the sheet S is conveyed through the discharging and turning portion 115 by the discharging rollers 116 until the sheet S becomes once partially exposed from the apparatus main assembly. Then, the sheet S is conveyed back into the apparatus main assembly by rotating in reverse the discharging rollers 116, and also, controlling the flapper 118 while the trailing end portion of the sheet S is still nipped between the discharging rollers 116 after it has passed through the flapper 118. Thereafter, the sheet S is conveyed to the registration rollers 110 by way of the re-feeding and conveying portions 119 and 120. Then, the sheet S is discharged onto the discharge tray 117 through the same path as that in the case of the one-side copy mode.

In the apparatus main assembly 100 having the constitution described above, image forming process devices, such as the developing device 201 as a developing means, a cleaner portion 202 as a cleaning means, and a primary charging device 203 as a charging means, are disposed around the photosensitive drum 104. Incidentally, the cleaner portion 202 is for removing the developer remaining on the photosensitive drum 104. The primary charging device 203 is for uniformly charging the peripheral surface of the photosensitive drum 104 to form a desired electrostatic image on the photosensitive drum 104.

Next, the developing device 201 will be described. The developing device 201 is configured to develop the electrostatic latent image formed on the photosensitive drum 104 by optical portion 103 based on the information of the original 101, by depositing developer on the electrostatic latent image. The developer supply container 1 for supplying developer to the developing device 201 is detachably mounted in the apparatus main assembly 100 by the operator.

Here, a constitution of a developer receiving device (developer supplying device) 140 provided in the apparatus main assembly in order to feed the developer (toner) accommodated inside the developer supply container 1 to the outside (the developing device 201) of the developer supply container 1 will be described with reference to FIG. 2.

The developer supply container 1 is detachably mountable to the developer receiving device provided in the image forming apparatus main assembly. When the developer supply container 1 is mounted, a projection (locking portion or coupling portion) 2*a* of a discharge opening sealing member 2 hook-engages with a hollow engaging member (locking member or driving member) 131 on the apparatus main assembly side. Specifically, the hollow engaging member 131 is provided with a hole 131*a* at its peripheral surface. The hole 131*a* is configured so that the projection 2*a* engages in the hole 131*a*. Through these engaging portions, an operation for unsealing a discharge opening or for resealing the discharge opening by the sealing member 2 is performed.

More specifically, a position of the discharge opening sealing member 2 with respect to a rotational axis direction (a direction indicated by a double-pointed arrow A in FIG. 3) of the container 1 is fixed by the locking (engagement) of the projection 2*a* with the engaging member 131. Thereafter, with respect to the positionally fixed discharge opening sealing member 2, the apparatus main assembly moves back a container body 1A in a direction in which the container body 1A is moved apart from the discharge opening sealing member 2, thus effecting the unsealing of the discharge opening.

On the apparatus main assembly side, a motor 130 is provided. The engaging member 131 driving-connected with the motor 130 is configured to be rotated by the motor 130. Therefore, a rotational driving force is transmitted to the sealing member 2 engaged with the engaging member 131. That is, the sealing member 2 is a driving force receiving portion for receiving, from the apparatus main assembly, the rotational driving force for rotating the developer supply container 1.

After the unsealing, when the driving force is applied from the motor 130 to the engaging member 131, the discharge opening sealing member 2 forming an engagement relationship with the engaging member 131 is also rotated through the projection 2*a*. At an inner surface of a buffer portion 1D, a rib extending toward a rotational center axis of the container 1 is provided and abutted against a connecting member 6 for the discharge opening sealing member 2, so that the transmission of the rotational driving force from the discharge opening sealing member 2 to the buffer portion 1D is performed. Therefore, an accommodating portion 1C provided so as to be rotatable integrally with the buffer portion ID is also rotated.

When the developer supply container 1 is demounted from the inside of the apparatus main assembly for exchanging the developer supply container 1, first, a step of resealing the discharge opening by the discharge opening sealing member 2 is performed. Specifically, the container body 1A is moved forward in a direction in which the position of the container body 1A comes near to the positionally fixed discharge opening sealing member 2, so that the resealing of the discharge opening by the discharge opening sealing member 2 is performed. That is, the discharge opening sealing member is integrated with the container body 1A.

Thereafter, the hook-engagement between the projection 2*a* and the hole 131*a* is disengaged by a hollow releasing ring 132 provided to the apparatus main assembly. Specifically, the apparatus main assembly slides the releasing ring 132 toward the developer supply container side, so that an inner surface of the releasing ring 132 contacts and pushes down inwardly a projection 2*b*. When the projection 2*b* is pushed down inwardly, the projection 2*a* provided integrally with the projection 2*b* is also pushed down inwardly, so that the engagement of the projection 2*a* with the hole 131*a* is released. Thus, an elastically deformable portion capable of being bent inwardly is provided at a free end portion of the sealing member 2. The projection 2*a* is provided to the free end of the elastically deformable portion and the projection 2*b* is provided on a base portion side of the elastically deformable portion.

In the state in which the engagement between the projection 2*a* and the hole 131*a* is released, the apparatus main assembly moves backward the container body 1A in the direction in which the container body 1A is moved away from the engaging member 131, so that a series of demounting preparatory steps is completed. Thereafter, the user can demount the developer supply container 1.

By the rotation of the developer supply container 1, the toner (developer) discharged from a developer discharge opening 1*a* is supplied to an opening of the developer receiving device 140. To the developer receiving device 140, a stirring member 141 for stirring the received developer and a feeding member 142 for feeding the stirred developer toward a developing device 201*a* are provided.

In FIG. 1, the developing device 201*a* includes a developing roller 201*b* and a feeding member 201*c*. The developer supplied from the developer supply container 1 is fed to the developing roller 201*b* by the feeding member 201*c* and then is supplied to the photosensitive drum 104 by the developing roller 201*b*.

(Developer Supply Container)

The developer supply container 1 according to Embodiment 1 of the present invention will be described.

Figure 3:
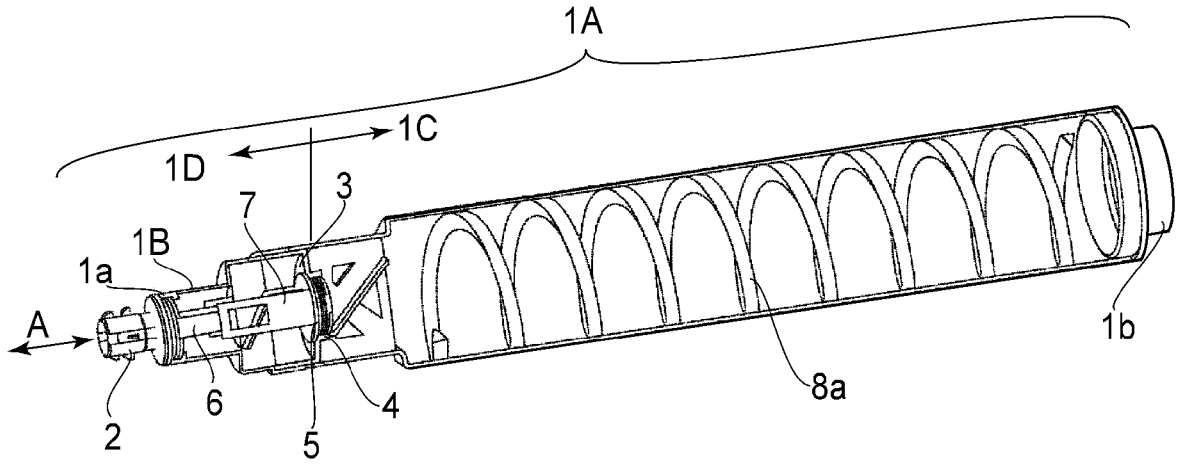
FIG. 3 is a partially perspective sectional view of a developer supply container according to Embodiment 1.

FIG. 3 is a partially perspective sectional view of the developer supply container 1 in Embodiment 1 of the present invention.

Referring to FIG. 3, the container body 1 is formed in a substantially cylindrical shape, and a cylindrical portion 1B having a diameter smaller them an outer diameter of the container body 1A is provided at substantially central portion of one end surface of the container body 1A and is projected from the end surface of the container body 1A. An end side of the cylindrical portion 1B constitutes a developer discharge opening 1*a* for permitting discharge of the developer toward the developing device side. Further, in the developer discharge opening 1*a*, the discharge opening sealing member (second sealing member) 2 is engaged by press fitting. The discharge opening sealing member 2 is slidably movable relative to the container body 1A in the rotational axis direction of the container body 1A (in the arrow A direction indicated in FIG. 3 (sealing member movement direction)). By this sliding movement, an unseal operation and a sealing operation of the developer discharge opening 1*a* are performed.

Further, at an end surface of the container body 1A opposite from the discharge opening 1*a*, a filling port 1*b* for filling the developer is provided. The developer supply container 1 is disposed in the image forming apparatus main assembly with respect to a substantially horizontal direction and is configured to rotate by receiving a rotational driving force from the engaging member 131 of the image forming apparatus main assembly. In FIG. 3, the developer discharge opening 1*a* is in a sealed state.

Next, an inner constitution of the developer supply container 1 will be described.

The inside of the container body 1A is partitioned by a partition member 3 into the accommodating portion (first chamber) for accommodating the developer and the buffer portion (second chamber) for receiving the developer from the accommodating portion 1C and permitting passing of the developer during the feeding of the developer toward the discharge opening 1*a*. That is, the buffer portion 1D is configured to connect a communication port (opening) 4 and the developer discharge opening 1*a*.

At a central portion of the partition member 3, the communication port 4 for establishing communication between the accommodating portion 1C and the buffer portion 1D is provided. In the partition member 3, the communication port sealing member (first sealing member) 5 capable of sealing the communication port 4 is engaged by press fitting. Specifically, a ring-like sealing portion provided to the communication port sealing member 5 is engaged in the partition member 3 by press fitting.

Similarly, the discharge opening sealing member 2 capable of sealing the developer discharge opening 1*a* is engaged in the buffer portion 1D by press fitting. Specifically, a ring-like sealing portion provided to the discharge opening sealing member 2 is engaged in the buffer portion 1D by press fitting.

Figure 4:
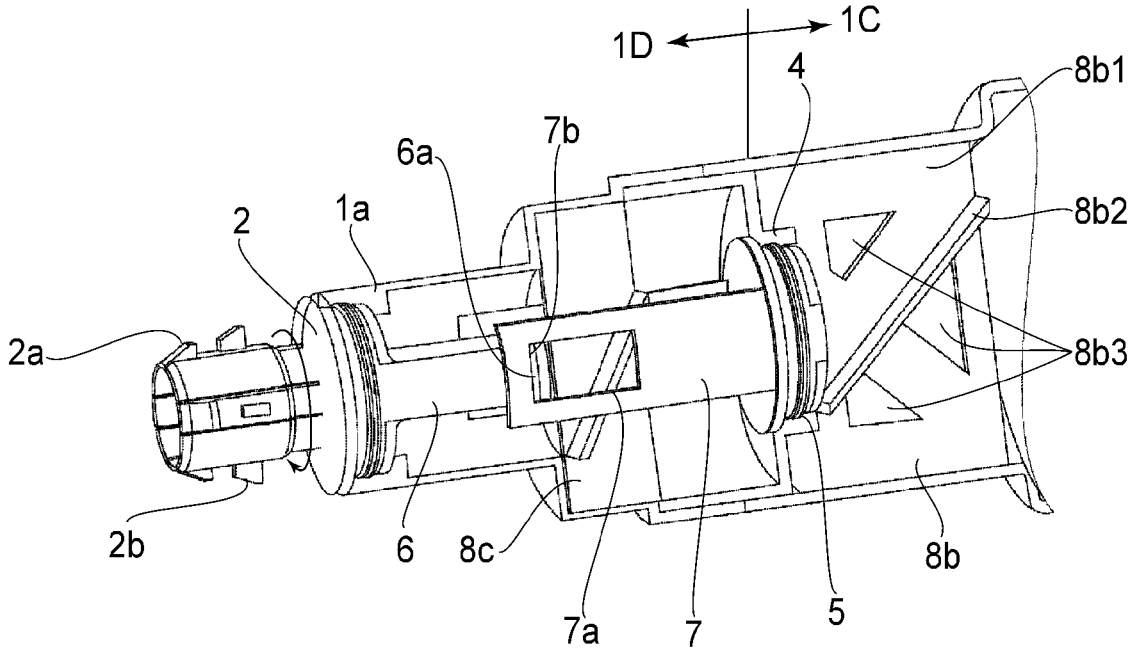
FIG. 4 is a partially perspective sectional view of a discharge opening and the neighborhood thereof in Embodiment 1.

Further, as shown in FIG. 4, in the buffer portion 1D, a connecting member (second engaging portion) 6 constituted integrally with the discharge opening sealing member 2 and a connecting member (first engaging portion) 7 constituted integrally with the communication port sealing member 5 are provided. These connecting members 6 and 7 function as a connecting portion of the interrelating mechanism described later.

The connecting member 7 constituted integrally with the communication port sealing member 5 includes an extended portion extended toward the discharge opening sealing member 2, and the extended portion is provided with an engaging slot 7*a*. Further, the connecting member 6 constituted integrally with the discharge opening sealing member 2 includes an extended portion extended toward the communication port sealing member 5, and the extended portion is provided with a claw portion (abutting portion) 6*a* on its free end side. This claw portion 6*a* is in a state in which it is engaged in the engaging slot 7*a*. The engaging slot 7*a* is sufficiently longer than the claw portion 6*a* and has a shape such that it extends in the rotational axis direction A (FIG. 3), and the claw portion 6*a* is configured to be slidably movable in the engaging slot 7*a* together with the discharge opening sealing member 2 (loose fitting). At a portion of the connecting member 7 defined by the engaging slot 7*a*, a contact surface (second engaging portion) 7*b* contactable to the claw portion 6*a* is provided.

Therefore, in the case where the discharge opening is unsealed, when the discharge opening sealing member 2 is sliding-moved relative to the buffer portion 1D, the claw portion forms an engaging relationship with the contact surface 7*a*, so that the communication port sealing member 5 is also sliding-moved relative to the accommodating portion 1*c* in interrelation with the discharge opening sealing member 2.

On the other hand, in the case where the discharge opening is resealed by the discharge opening sealing member 2, when the discharge opening sealing member 2 is sliding-moved relative to the buffer portion 1D, the claw portion 6*a* is configured to merely slide in the engaging slot 7*a*, so that the discharge opening sealing member 2 does not transmit a force for resealing the communication port by the communication port sealing member 5 to the connecting member 7. Therefore, even when the discharge opening sealing member 2 is sliding-moved for resealing the discharge opening by the discharge opening sealing member 2, the communication port is not resealed by the communication port sealing member 5, so that the sliding movement of the discharge opening sealing member 2 is effected alone.

That is, the discharge opening sealing member 2 and the communication port sealing member 5 are configured so that two unsealing operations of the openings are performed in interrelation with each other but the discharge opening sealing member 2 is also configured so that the resealing operation of the discharge opening by the discharge opening sealing member 2 is independently performed (i.e., is not in interrelation with the operation with the communication port sealing member 5). The interrelating mechanism (connecting mechanism) will be described later.

In the accommodating portion 1C, a feeding portion 8*a* for feeding the developer toward the communication port 4 by rotation of the container body 1A is provided over a longitudinal direction of the container body 1A. The feeding portion 8*a* in the accommodating portion 1C has a shape such that it projects from an inner (wall) surface of the container, and is disposed in a helical shape along the inner surface of the container.

Further, in the accommodating portion 1C, a developer feeding portion 8*b* for scooping up the developer present in the neighborhood of the above-described communication port 4 and for feeding the scooped developer into the communication port 4.

The developer feeding portion 8*b* includes a partition plate 8*b*1 for partitioning the inside of the accommodating portion 1C, an inclined plate 8*b*2 provided on both sides of the partition plate 8*b*1, and holes 8*b*3 provided in the partition plate 8*b*1. By rotation of the container in a direction indicated by an arrow in FIG. 4, the partition plate 8*b*1 scoops up the developer and the scooped developer is guided to the communication port 4 along an inclined surface of the inclined plate 8*b*2. Further, through the holes 8*b*3, the developer can move between the both sides of the partition plate 8*b*1. For this reason, the developer takes in air to be enhanced in flowability, thus being improved in discharging property.

In the buffer portion (second accommodating portion) 1D, a developer feeding portion 8*c* for scooping up the developer fed into the buffer portion 1D by the rotation of the container body 1A to feed the scooped developer toward the discharge opening 1*a* is provided.

In the container constitution in this embodiment, when the developer is filled in the accommodating portion 1C through the filling port 1*b*, the filling is performed in a state in which the communication port 4 is sealed, the developer is not accommodated in the buffer portion 1D, so that the buffer portion 1D is in an empty state. Then, after the discharge opening and the communication port are unsealed, the developer is fed from the accommodating portion 1C to the buffer portion 1D by the rotation of the container body 1A, thus being discharged from the discharge opening 1*a* through the buffer portion 1D.

Thus, the developer is discharged after being temporarily stored in the buffer portion 1D, so that the developer can be prevented from concentrating at the discharge opening 1*a* during the developer discharging. As a result, it is possible to solve the problem that the discharge opening 1*a* is blocked due to the concentration of the developer at the discharge opening 1*a*.

(Interrelating Mechanism)

Figure 5:
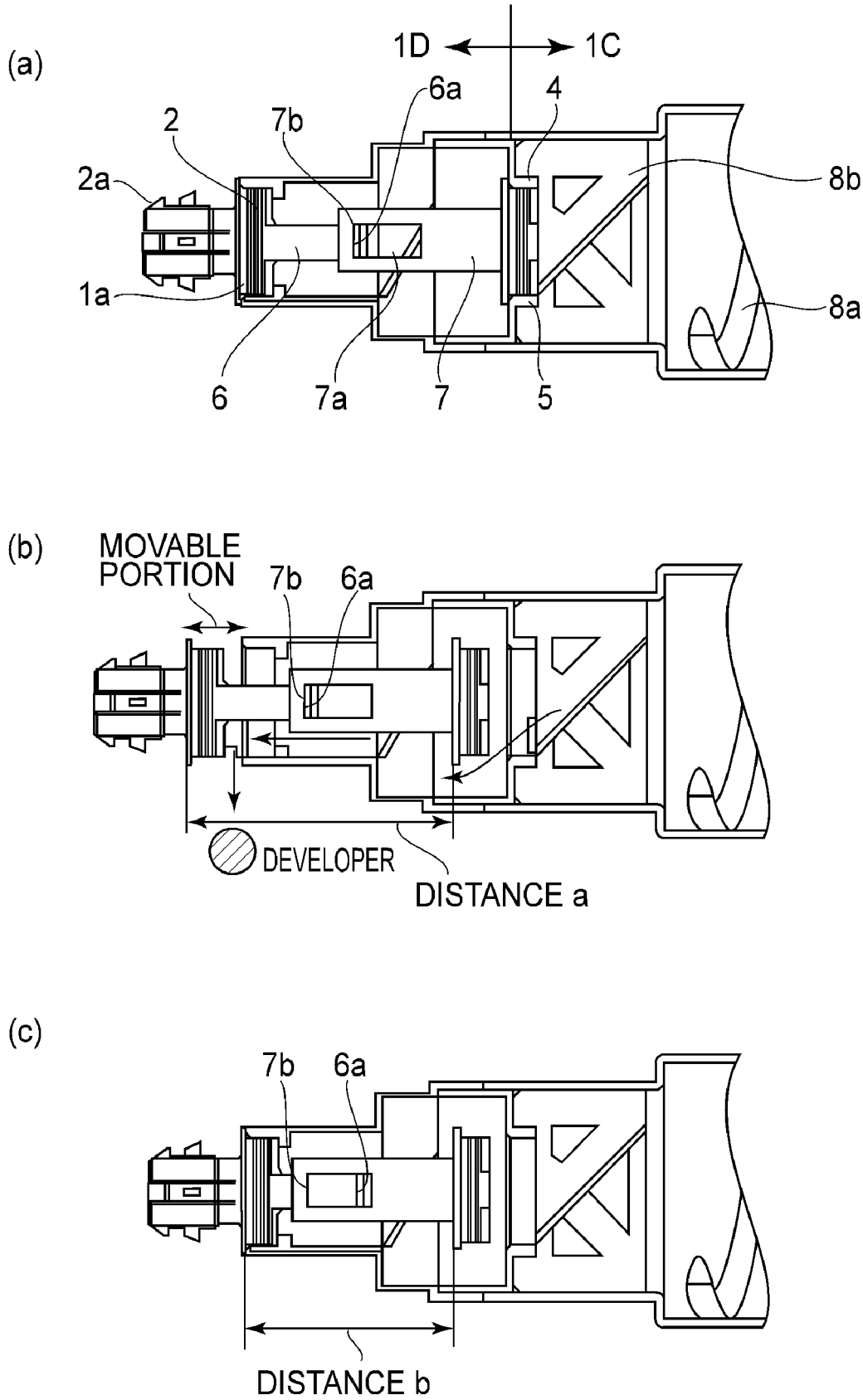
FIGS. 5(*a*), 5(*b*) and 5(*c*) are sectional views each showing a state of the discharge opening when the discharge opening is opened (unsealed) or closed (sealed).

Next, the connecting members 6 and 7 functioning as the interrelating mechanism (connecting mechanism) for interrelating the unsealing operation of the discharge opening (sliding movement of the discharge opening sealing member 2) with the unseal operation of the communication port (sliding movement of the communication port sealing member 5) and for permitting the resealing operation of the discharge opening by the discharge opening sealing member 2 (sliding movement of the discharge opening sealing member 2) without resealing the communication port by the communication port sealing member 5 (sliding movement of the communication port sealing member 5) will be specifically described with reference to FIGS. 5(*a*) to 5(*c*). In this embodiment, the interrelating mechanism is configured to interrelating the unsealing operations of the discharge opening and the communication port with each other but is configured so as not to perform the resealing by the communication port sealing member 5 when the resealing with the discharge opening sealing member 2 is performed.

As shown in FIG. 5(*a*), before start of use of the container, the discharge opening sealing member 2 and the communication port sealing member 5 are engaged in the discharge opening 1*a* and the communication port 4, respectively, by press fitting to seal the discharge opening 1*a* and the communication port 4, respectively. In this state, in this embodiment, the claw portion 6*a* of the connecting member 6 and the contact surface 7*b* of the connecting member 7 are in a mutually contact state. However, the claw portion 6*a* and the contact surface 7*b* are not necessarily required to contact each other. That is, the claw portion 6*a* and the contact surface 7*b* may be configured to create some gap therebetween so long as the unsealing operations of the discharge opening and the communication port are properly interrelated with each other.

FIG. 5(*b*) shows a state of the interrelating mechanism during the unsealing operations when the use of the container is stated. When the discharge opening sealing member 2 is moved in an unsealing direction, the claw portion 6*a* and the contact surface 7*b* contact and connect with each other, so that the connecting member 7 is pulled by the connecting member 6 to be moved in the same direction as that of the discharge opening sealing member 2. At this time, the communication port sealing member 5 constituted integrally with the connecting member 7 is also moved in the same direction as that of the discharge opening sealing member 2 in interrelation with the discharge opening sealing member 2, so that the communication port in the container is also unsealed.

As a result, the developer can be fed from the accommodating portion 1C toward the buffer portion 1D, so that the developer is discharged from the discharge opening 1*a* through the buffer portion 1D. Incidentally, a distance between the discharge opening sealing member 2 and the communication port sealing member 5 with respect to the movement direction of the discharge opening sealing member 2 during the unsealing operations is represented by distance a in FIG. 5(*b*).

When the container is demounted from the apparatus main assembly in order to be exchanged, the sealing operation of the discharge opening 1*a* is performed by moving the discharge opening sealing member 2 to the sealing position. During this sealing operation, as shown in FIG. 5(*c*), the claw portion 6*a* is moved apart from the contact surface 7*b*, so that the connecting member 7 is not moved and thus the claw portion 6*a* only moves in the engaging slot 7*a*.

For that reason, only the discharge opening sealing member 2 moves to the sealing position and the communication port sealing member 5 constituted integrally with the connecting member 7 is configured so that it is not interrelated with the discharge opening sealing member 2 different from the case of the unsealing operation and thus the communication port sealing member 5 cannot move to the sealing position of the communication port 4. A distance between the discharge opening sealing member 2 and the communication port sealing member 5 with respect to the movement direction of the discharge opening sealing member 2 during the sealing operation is represented by distance b in FIG. 5(*c*).

According to this embodiment, the distance b during the sealing operation is configured to be shorter than the distance a during the unsealing operation.

As described above, this embodiment employs the constitution in which the claw portion 6*a* and the contact surface 7*b* provided to the connecting members 6 and 7 are separated from each other during the sealing operation and therefore the discharge opening sealing member 2 and the communication port sealing member 5 are not moved in interrelation with each other. As a result, different from the conventional developer supply container in which the two sealing members 2 and 5 are interrelated with each other also during the sealing operation, movement of the communication port sealing member 5 is not prevented by the developer present in the container during the demounting of the container in use.

That is, in the conventional developer supply container, due to the prevention of the movement by the developer, the communication port sealing member 5 cannot move to the sealing position, so that the discharge opening sealing member 2 constituted integrally with the communication port sealing member 5 also cannot move to the sealing position. Therefore, there was the possibility of the occurrence of improper sealing.

On the other hand, according to the present invention, the discharge opening sealing member 2 and the communication port sealing member 5 are configured so as not to be interrelated with each other during the sealing operation of the discharge opening 1*a*. As a result, even when the communication port sealing member 5 does not reach the sealing position due to the movement prevention by the developer present inside the container, it is possible to seal the discharge opening 1*a* by the discharge opening sealing member 2 with reliability.

Incidentally, during the sealing operation by the discharge opening sealing member 2, as shown in FIG. 5(*b*), by a movable portion of the discharge opening sealing member 2, the developer in the neighborhood of the discharge opening 1*a* is easily discharged and dropped from the container. In this embodiment, the discharge opening 1*a* can be sealed with reliability without being affected by the movement prevention of the communication port sealing member 5 by the developer as in the case of sealing the communication port by the communication port sealing member 5 in the conventional developer supply container.

In this embodiment, the discharge opening sealing member 2 and the connecting member 6 are integrally molded by injection molding and the communication port sealing member 5 and the connecting member 7 are integrally molded by injection molding. However, each of the integrally-molded product of the discharge opening sealing member 2 and the connecting member 6 and the integrally-molded product of the communication port sealing member 5 and the connecting member 7 may also be prepared as separate parts and then the separate parts may be integrated by connecting the parts with an adhesive or the like.

Other constitutions as modified embodiments will be described below.

(First Another Constitution)

First Another Constitution will be described with reference to FIGS. 6(*a*) to 6(*c*).

In this constitution, a connecting member 9 extended from the discharge opening sealing member 2 is provided so as to pass through the communication port sealing member 5. The connecting member 9 and the communication port sealing member 5 engage with each other with a predetermined clearance, thus being movable relative to each other. In an area 9*c* in which the connecting member 9 passes through the communication port sealing member 5, a contact surface 9*a* (first contact portion) contactable to the contact surface 5*a* (second contact portion) of the communication port sealing member 5 is provided.

Figure 6:
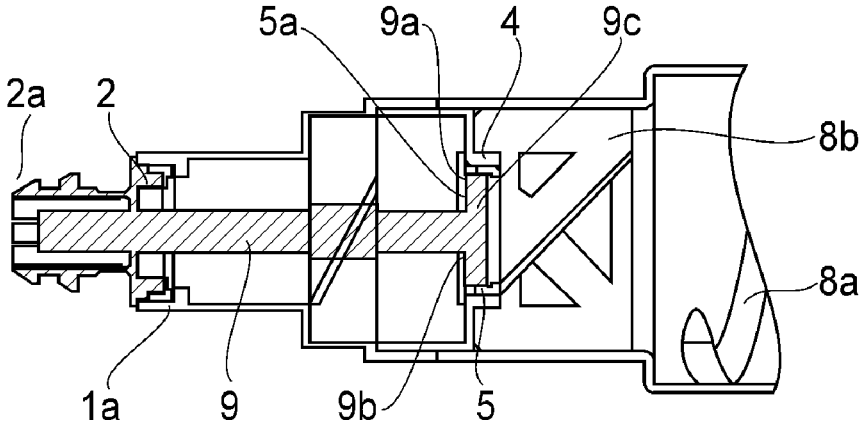
FIGS. 6(*a*), 6(*b*) and 6(*c*) are sectional views each showing a state of the discharge opening when the discharge opening is opened or closed in an embodiment different from that shown in FIGS. 5(*a*), 5(*b*) and 5(*c*).
Figure 6:
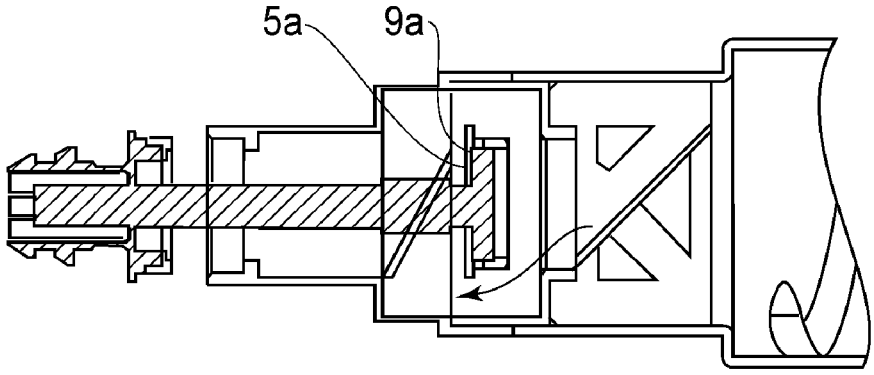
Figure 6:
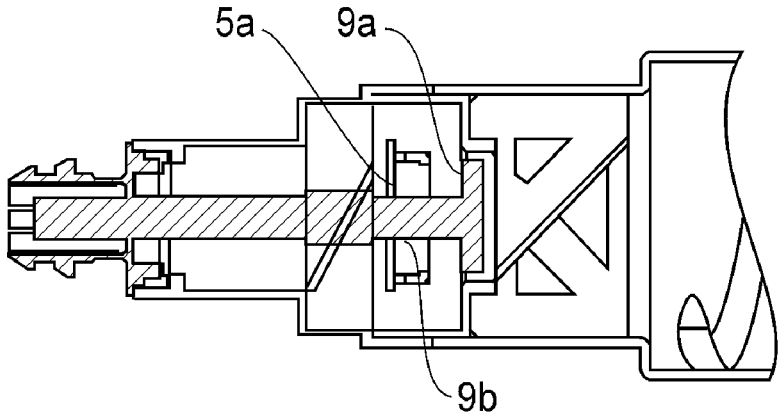

FIG. 6(*a*) shows a state, before the start of use of the container, in which both of the discharge opening sealing member 2 and the communication port sealing member 5 are located at associated ones of the sealing positions.

FIG. 6(*b*) shows a state during the unsealing operation of the discharge opening. When the discharge opening sealing member 2 is moved in the unsealing direction of the discharge opening 1*a*, the contact surface 9*a* of the connecting member 9 and the contact surface 5*a* of the communication port sealing member 5 contact each other. By this contact, the discharge opening sealing member 2 is connected with the communication port sealing member 5 to be movable together, so that the communication port 4 is unsealed.

On the other hand, FIG. 6(*c*) shows a state during the resealing operation by the discharge opening sealing member 2. When the discharge opening sealing member 2 is moved in the sealing direction of the discharge opening 1*a*, the movement of the communication port sealing member 5 is prevented by the developer in the container, so that the communication port sealing member 5 does not move in the sealing direction and only the connecting member 9 having passed through the communication port sealing member 5 moves in the sealing direction.

As a result, an effect similar to that in Embodiment 1 can be obtained.

(Second Another Constitution)

Second Another Constitution will be described with reference to FIGS. 7(*a*) to 7(*c*).

In this constitution, a connecting member 10 extended from the communication port sealing member 5 is provided so as to pass through the discharge opening sealing member 2. The connecting member 10 and the discharge opening sealing member 2 engage with each other with a predetermined clearance, thus being movable relative to each other. In an area 10*c* in which the connecting member 10 passes through the discharge opening sealing member 2, a contact surface 10*a* (second contact portion) contactable to the contact surface 2*a* (first contact portion) of the discharge opening sealing member 2 is provided.

Figure 7:
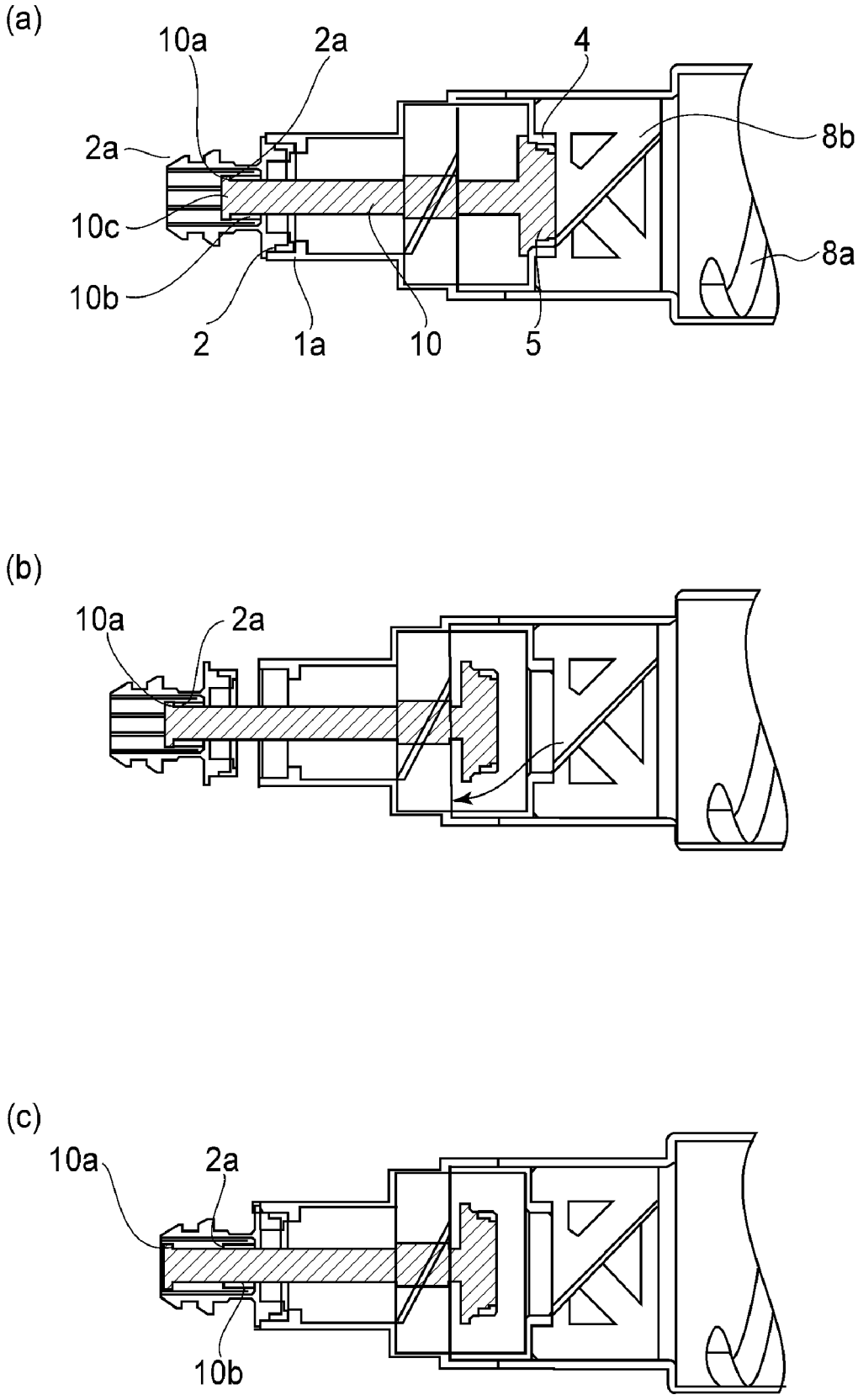
FIGS. 7(*a*), 7(*b*) and 7(*c*) are sectional views each showing a state of the discharge opening when the discharge opening is opened or closed in an embodiment different from that shown in FIGS. 5(*a*), 5(*b*) and 5(*c*) and that shown in FIGS. 6(*a*), 6(*b*) and 6(*c*).

FIG. 7(*a*) shows a state, before the start of use of the container, in which both of the discharge opening sealing member 2 and the communication port sealing member 5 are located at associated ones of the sealing positions.

FIG. 7(*b*) shows a state during the unsealing operation of the discharge opening. When the discharge opening sealing member 2 is moved in the unsealing direction of the discharge opening 1*a*, the contact surface 10*a* of the connecting member 10 and the contact surface 2*a* of the discharge opening sealing member 2 contact each other. By this contact, the discharge opening sealing member 2 is connected with the communication port sealing member 5 to be movable together, so that the communication port 4 is unsealed.

On the other hand, FIG. 7(*c*) shows a state during the resealing operation by the discharge opening sealing member 2. When the discharge opening sealing member 2 is moved in the sealing direction of the discharge opening 1*a*, the movement of the communication port sealing member 5 is prevented by the developer in the container, so that the communication port sealing member 5 does not move in the sealing direction. Therefore, relative to the connecting member 10 which does not more similarly, only the discharge opening sealing member 2 moves in the sealing direction.

As a result, an effect similar to that in Embodiment 1 can be obtained.

Further, as shown in FIGS. 7(*a*) to 7(*c*), compared with the constitution in which a sliding portion 9*b* at which the connecting member 9 passes through the communication port sealing member 5 in the container as shown in FIGS. 6(*a*) to 6(*c*), the deposition of the developer on the sliding portion is less in the constitution in which a sliding portion 10*b* at which the connecting member 10 passes through the discharge opening sealing member 2 as shown in FIGS. 7(*a*) to 7(*c*). Therefore, an amount of the developer under load by the sliding between the connecting member 10 and the sliding portion 10*b* during the separation between the contact surfaces with respect to the discharge opening sealing member 2 is small, so that a possibility that agglomerated particles of the developer are generated is low. As a result, this constitution (FIGS. 7(*a*) to 7(*c*)) is preferable since it is possible to prevent the adverse affect of developer coarse particles on the resultant image to provide a stable image.

Embodiment 2

Next, with reference to FIGS. 8(*a*) to 8(*c*), Embodiment 2 of the present invention will be described.

In this embodiment, the buffer portion 1D is configured so that a flexible connecting member (flexible member) 11 for connecting the discharge opening sealing member 2 and the communication port sealing member 5 is provided in place of the connecting members 6 and 7 in Embodiment 1. Other constitutions are identical to those in Embodiment 1.

Figure 8:
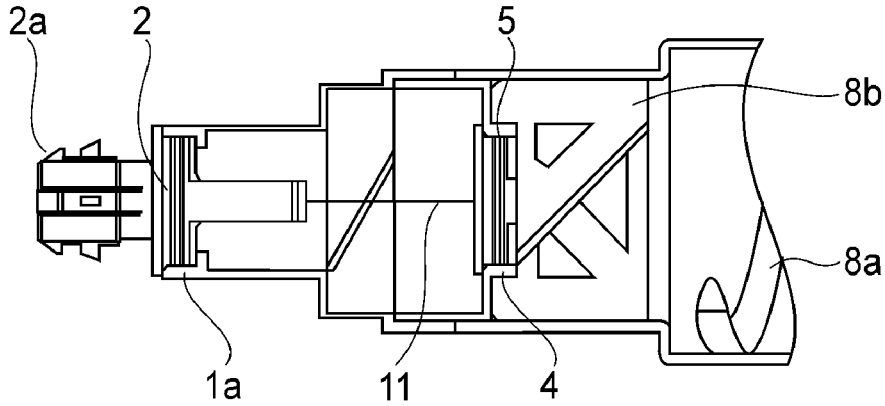
FIGS. 8(*a*), 8(*b*) and 8(*c*) are sectional views each showing a state of the discharge opening when the discharge opening is opened or closed in Embodiment 2.
Figure 8:
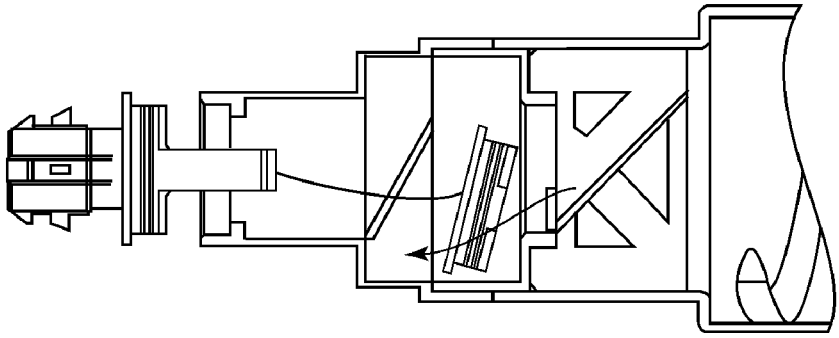
Figure 8:
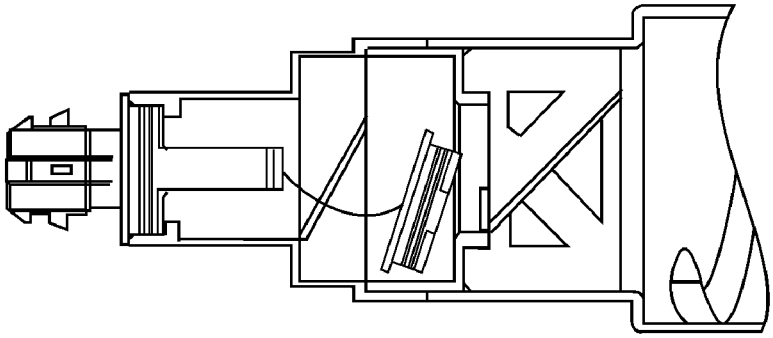

In this embodiment, as shown in FIG. 8(*b*), when the discharge opening 1*a* is unsealed, the communication port sealing member 5 is also pulled by the flexible connecting member 11 in interrelation with the movement of the discharge opening sealing member 2. However, when the discharge opening 1*a* is resealed, as shown in FIG. 8(*c*), the connecting member 11 is bent and therefore the communication port sealing member 5 cannot move to the sealing position, so that only the discharge opening 1*a* is sealed by the discharge opening sealing member 2. Thus, similarly as in Embodiment 1, during the resealing of the discharge opening 1*a*, the discharge opening sealing member 2 and the communication port sealing member 5 are not interrelated with each other, so that the discharge opening sealing member 2 can seal the discharge opening 1*a* with reliability.

Further, in this constitution, the flexible connecting member 11 is provided, so that there is no need to provide the connecting members 6 and 7 having the contact surfaces as in Embodiment 1 and therefore the constitution is simplified. As a result, the number of parts is decreased, thus leading to cost reduction. Incidentally, the connecting member 11 may only be required to have a bendable (flexible) constitution such as a string-like constitution or a bellow-like constitution and therefore a shape and a material thereof are not limited.

Embodiment 3

Figure 10:
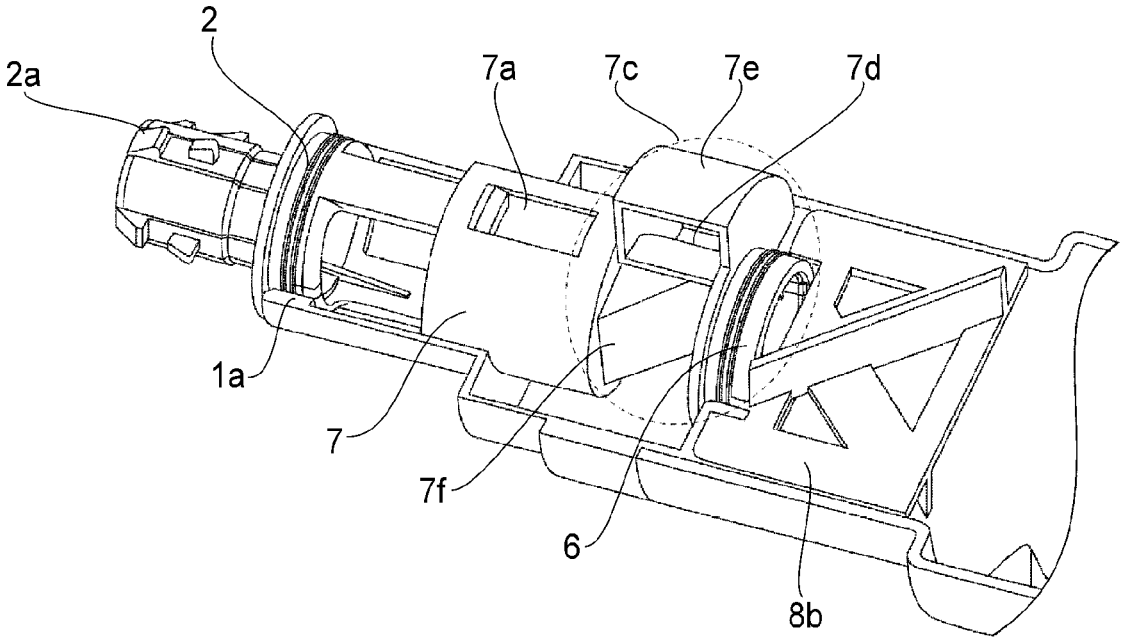
FIG. 10 is a partially perspective sectional view of a discharge opening and the neighborhood thereof in Embodiment 3.

A difference from Embodiment 1 is that the connecting member 7 provided in the buffer portion 1D and constituted integrally with the communication port sealing member 7 includes a feeding portion 7*c*. Here, a constitution of the feeding portion 7*c* and its adjacent portions is shown in FIG. 10. The feeding portion 7*c* includes an intake port 7*d* for the developer, a feeding pipe 7*e* for the taken developer, and an inclined portion 7*f* for feeding the developer to the discharge opening 1*a*. Incidentally, other constitutions are identical to those in Embodiment 1. A state of the developer feeding at the feeding portion 7*c* will be specifically described later.

Figure 11:
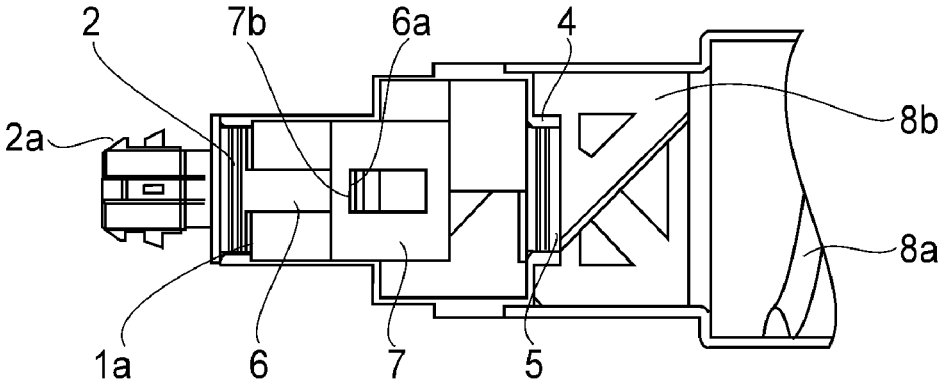
FIGS. 11(*a*), 11(*b*) and 11(*c*) are sectional views each showing a state of the discharge opening when the discharge opening is opened or closed in Embodiment 3.
Figure 11:
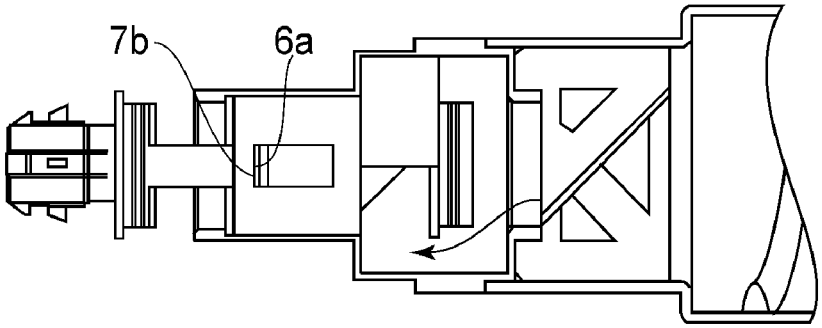
Figure 11:
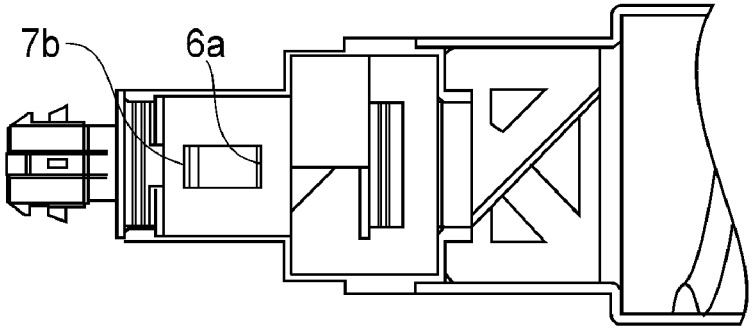

As shown in FIGS. 11(*a*) and 11(*b*), in this embodiment, similarly as in Embodiment 1, the claw portion 6*a* and the contact surface 7*b* contact each other during the unsealing with the discharge opening sealing member 2, so that the connecting member 7 is moved in a pulling manner in the same direction as the movement direction of the discharge opening sealing member 2. At this time, the communication port sealing member 5 constituted integrally with the connecting member 7 is also moved in interrelation with the connecting member 7, so that the communication port 4 in the container is unsealed.

Further, as shown in FIG. 11(*c*), during the resealing with the discharge opening sealing member 2, the claw portion 6*a* and the contact surface 7*b* are moved apart from each other. As a result, only the discharge opening sealing member 2 moves to the sealing position and the communication port sealing member 5 does not move to the sealing position of the communication port 4. Therefore, also in this embodiment, the discharge opening sealing member 2 and the communication port sealing member 5 are not interrelated with each other during the resealing of the discharge opening 1*a*, so that the discharge opening sealing member 2 can seal the discharge opening 1*a* with reliability.

In this embodiment, the connecting member 7 includes the feeding portion 7*c* as described above, so that there is no need to provide the developer feeding portion 8*c* provided in the buffer portion 1D as in Embodiment 1. Therefore, the number of parts is reduced by this constitution, so that productivity is improved.

Figure 12:
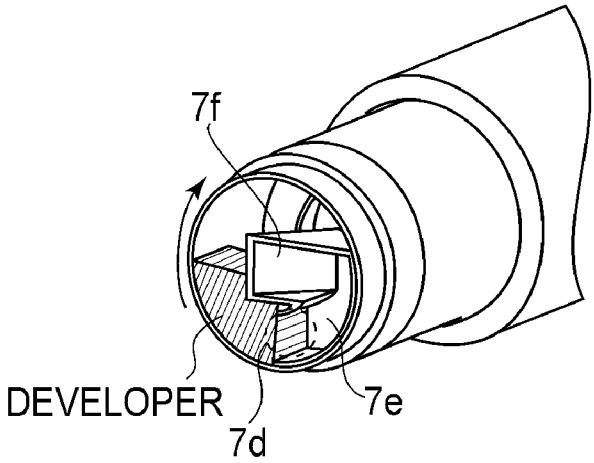
FIGS. 12(*a*), 12(*b*) and 12(*c*) are perspective sectional views showing flow of the developer at a feeding portion in Embodiment 3.
Figure 12:
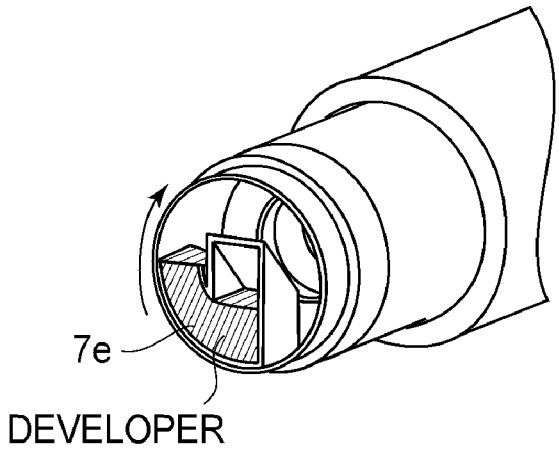
Figure 12:
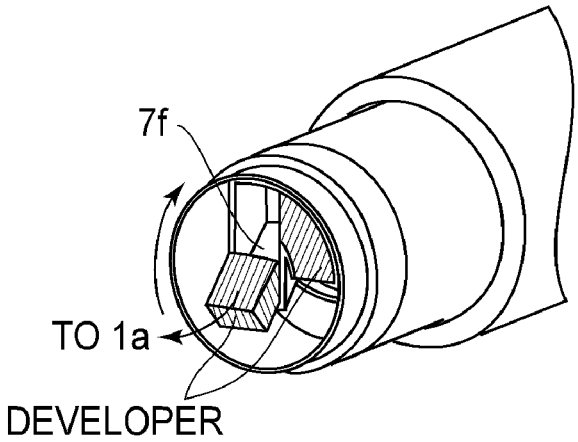

Further, in this embodiment, the developer fed from the accommodating portion 1C to the buffer portion 1D is fed toward the discharge opening 1*a* by the feeding portion 7*c*. Here, a state of the developer feeding is shown in FIGS. 12(*a*) to 12(*c*). By the rotation of the container body 1A, as shown in FIG. 12(*a*), the developer is taken in through the intake port 7*d*.

Then, when the container body 1A is further rotated, the taken developer passes through the feeding pipe 7*e* by the rotation of the container.

Then, as shown in FIG. 12(*c*), a certain amount of the developer on the inclined portion 7*f* slides off the inclined portion 7*f* and is fed toward the discharge opening 1*a*. Thus, the developer can be discharged with the certain amount by the feeding portion 7*c*. As a result, it is possible to prevent the case where a large amount of the developer is discharged and exceeds a tolerable amount at a discharged portion and the reverse case where the discharge amount is small and therefore a supply amount is insufficient.

Therefore, in this embodiment, by the feeding portion 7*c*, the developer in an amount stabler than that in Embodiment 1 can be supplied to the accommodating main assembly.

As described above, in order that the feeding portion 7*c* obtains a stable constant-amount discharging property, the intake port 7*d* is required to have a small opening area and the feeding pipe 7*e* is required to be constituted in a narrow pipe shape. However, in the case where the constitution of the buffer portion 1D provided with no feeding portion was employed as it is, there was a possibility of an occurrence of the following problem when the developer supply container was transported and stored for a long term in a state in which the discharge opening 1*a* was directed downward. That is, such a problem that the developer is in a tight state at the feeding portion 7*c* and blocks the feeding portion 7*c* occurs.

Therefore, in this embodiment, in order to prevent the blockage of the feeding portion 7*c*, the constitution in which the feeding portion 7*c* is provided in the buffer portion 1D capable of maintaining an empty state until the discharge opening 1*a* is unsealed is employed. As a result, the buffer portion 1D is closed by sealing of the communication port 4 even in the states of the transportation and long-term storage, so that the buffer portion 1D can maintain its empty state until the discharge opening 1*a* is unsealed.

As a result, the blockage of the feeding portion 7*c* with the developer is not caused to occur. Further, the opening area of the communication port 4 is, different from that of the intake port 7*d*, not required to have the function of the constant-amount discharge, so that design latitude is high.

Therefore, the communication port 4 varies in a degree of the blockage depending on specifications of the developer, a shape of the container body 1A, and the like, so that the opening area of the communication port 4 can be appropriately set at a level at which the developer does not block the communication port 4 and can pass through the communication port 4. As a result, in this embodiment, the developer is fed to the buffer portion 1D through the communication port 4 with reliability when the discharge opening 1*a* is unsealed, so that the developer can be discharged in a constant amount by the developer feeding portion 7*c*.

In the constitution in this embodiment, during the resealing of the discharge opening 1*a*, when the sealing members are always moved together as in the conventional developer supply container, interposition of the developer present in the neighborhood of the communication port 4 occurs noticeably. This is because the feeding portion 7*c* is provided in addition to the conventional communication port sealing member 5 and therefore an amount of the developer interposed between the communication port sealing member 5 and the partition member 3 is increased. Therefore, to the constitution including the feeding portion 7*c*, by applying the present invention, the interposition of the developer can be prevented and the improper sealing can be effectively suppressed.

Figure 13:
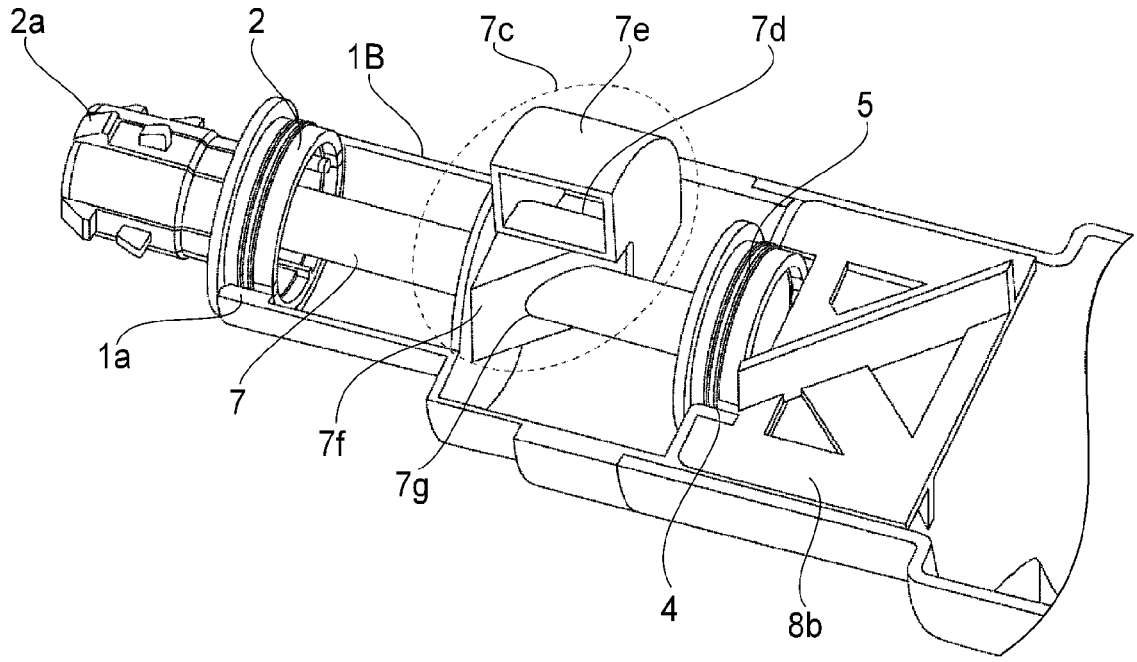
FIG. 13 is a partially perspective sectional view of the discharge opening and the neighborhood thereof in an embodiment different from that shown in FIG. 9.

Further, in this embodiment, the connecting member 7 and the feeding portion 7*c* are integrally constituted and are configured to move the feeding portion 7*c* in interrelation with the movement of the connecting member 7 but, as shown in FIG. 13, it is also possible to employ a constitution in which the feeding portion 7*c* is fixed and only the connecting member 7 is movable. That is, in this constitution, the feeding portion 7*c* is provided with a hole 7*g* through which the connecting member 7 passes.

Embodiment 4

Figure 14:
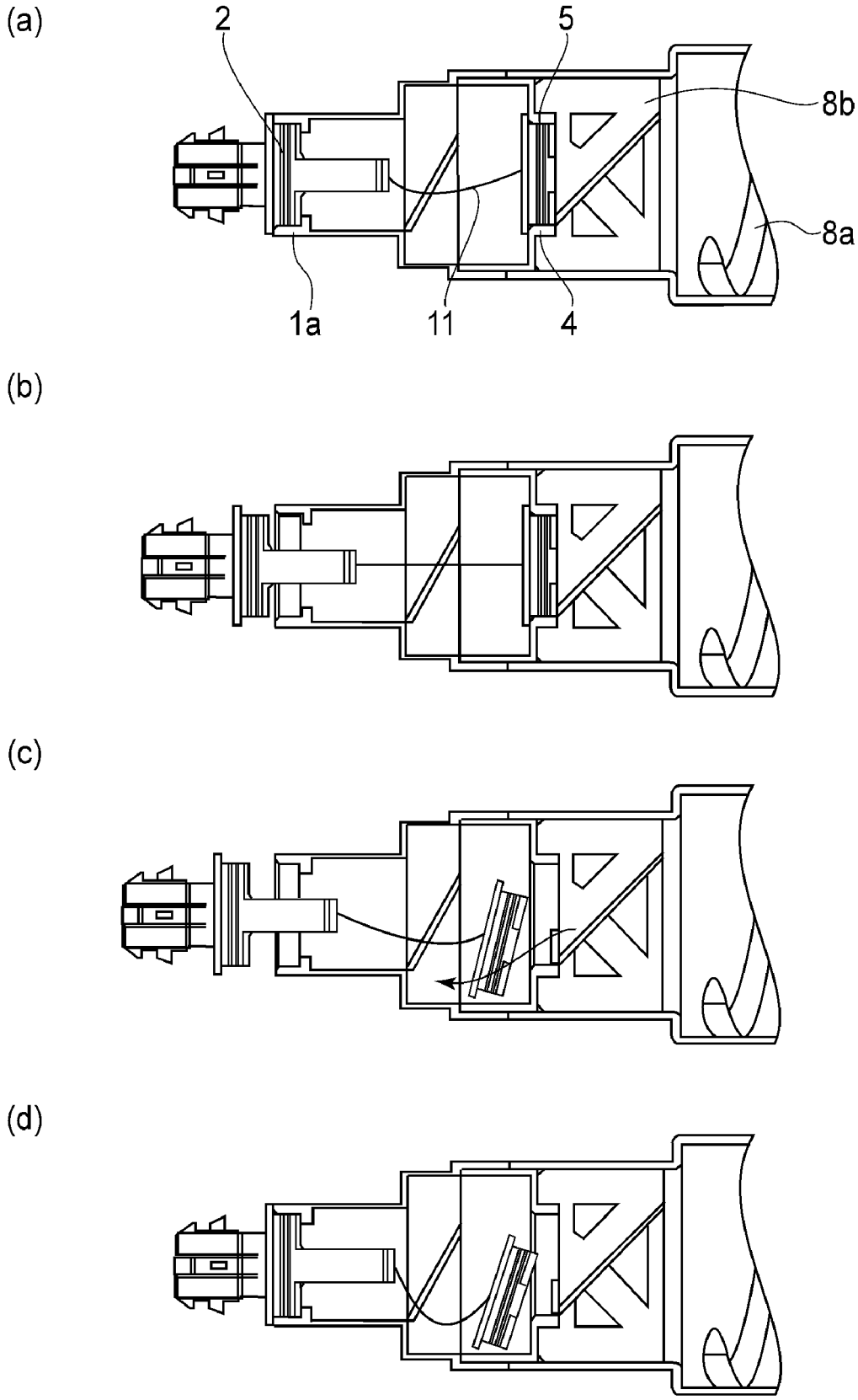
FIGS. 14(*a*), 14(*b*), 14(*c*) and 14(*d*) are sectional views each showing a state of a discharge opening when the discharge opening is opened or closed in Embodiment 4.

With reference to FIGS. 14(*a*) to 14(*d*) and FIGS. 15(*a*) to 15(*d*), Embodiment 4 of the present invention will be described.

First, as shown in FIG. 14(*a*), before the use of the container is stated, the flexible connecting member 11 provided in the buffer portion 1D in Embodiment 2 connects the discharge opening sealing member 2 and the connect sealing member 5 in a bent state. Incidentally, other constitutions are identical to those in Embodiment 2.

By the constitution in this embodiment, when the discharge opening 1*a* is unsealed, as shown in FIG. 14(*b*), the discharge opening 1*a* is first unsealed. Thereafter, the connecting member 11 is placed in an unbent state by being pulled by the discharge opening sealing member 2 and then the communication port 4 is unsealed by being pulled by the connecting member 11 as shown in FIG. 14(*c*). That is, the constitution in which, during the unsealing operation, the communication port 4 is unsealed after the discharge opening 1*a* is unsealed is employed. Further, during the resealing of the discharge opening 1*a*, the connecting member 11 is bent and therefore the communication port sealing member 5 cannot move to the sealing position, so that only the discharge opening 1*a* is sealed by the discharge opening sealing member 2. Therefore, during the resealing of the discharge opening 1*a*, the discharge opening sealing member 2 and the communication port sealing member 5 are not interrelated with each other, so that the discharge opening sealing member can seal the discharge opening 1*a* with reliability.

Further, in this embodiment, during the unsealing of the discharge opening 1*a*, compared with the case where the two openings are unsealed at the same time as in Embodiment 2, the two openings are unsealed with a difference in time. For this reason, a force required for unsealing each of the openings is small. Therefore, when the user unseals the openings, the unsealing operation becomes easy and it becomes possible to use a motor with a small unsealing force when the openings are unsealed by using the motor.

Further, another embodiment will be described.

Figure 15:
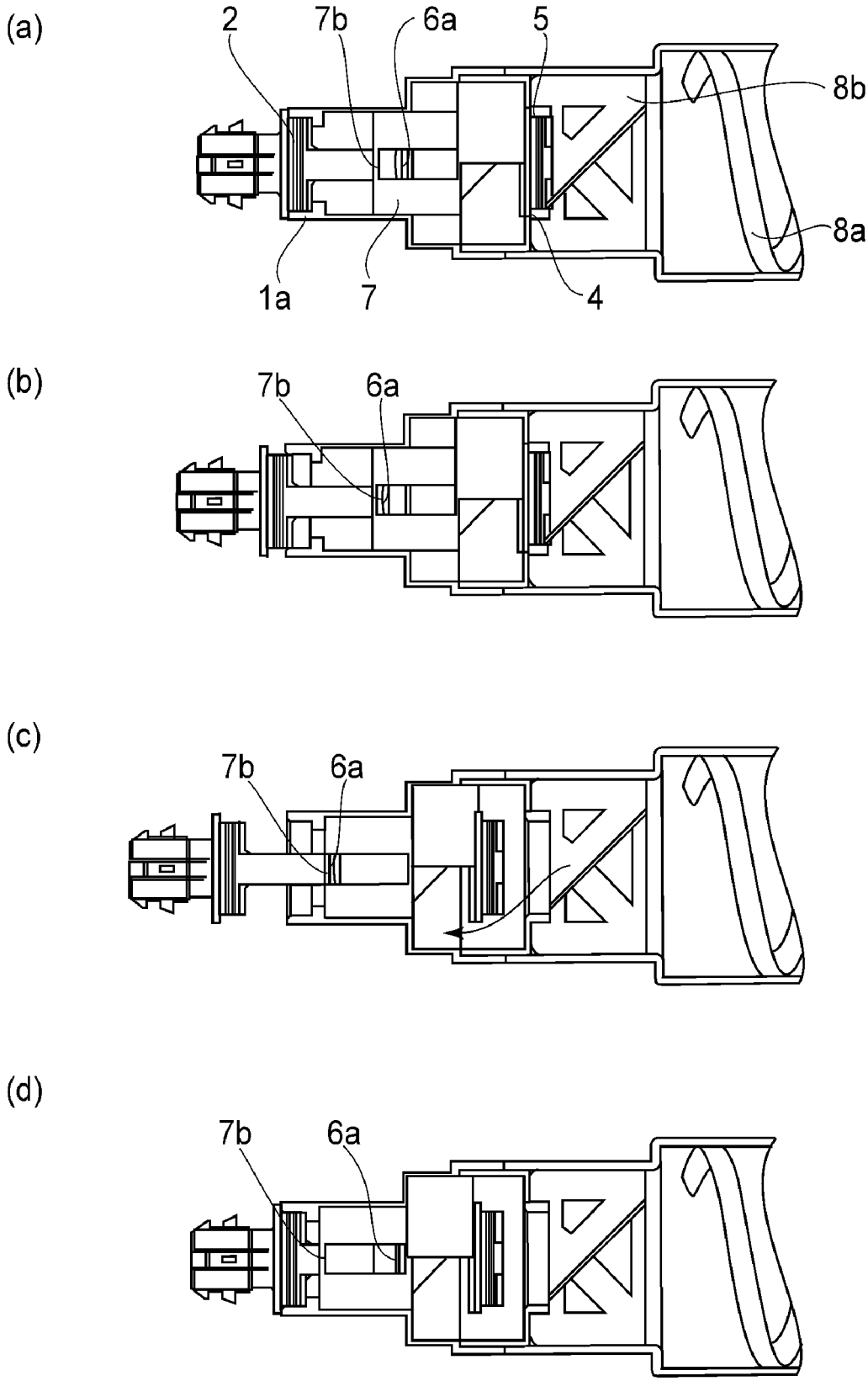
FIGS. 15(*a*), 15(*b*), 15(*c*) and 15(*d*) are sectional views each showing a state of a discharge opening when the discharge opening is opened or closed in an embodiment different from that shown in FIGS. 15(*a*), 15(*b*), 15(*c*) and 15(*d*).

As shown in FIG. 15(*a*), before the start of the use of the container, different from Embodiment 3, the claw portion 6*a* and the contact surface 7*b* are in the separated state. Incidentally, other constitutions are identical to those in Embodiment 3.

During the unsealing of the discharge opening 1*a*, as shown in FIG. 15(*b*), first, the discharge opening 1*a* is unsealed. Thereafter, the claw portion 6*a* and the contact surface 7*b* are placed in a contact state, so that the connecting member 7 is moved in a pulling manner in the same direction as the movement direction of the discharge opening sealing member 2 as shown in FIG. 15(*c*). At this time, the communication port sealing member 5 constituted integrally with the connecting member 7 is also moved in interrelation with the connecting member 7, so that the communication port 4 in the container is unsealed.

Further, during the resealing of the discharge opening 1*a*, as shown in FIG. 15(*d*), the claw portion 6*a* and the contact surface 7*b* are moved apart from each other, so that the communication port sealing member 5 cannot move to the sealing position and only the discharge opening 1*a* is sealed by the discharge opening sealing member 1.

Thus, also in this embodiment, during the resealing of the discharge opening 1*a*, the claw portion 6*a* and the contact surface 7*b* are moved apart from each other, so that the communication port sealing member 5 cannot move to the sealing position and only the discharge opening 1*a* is sealed by the discharge opening sealing member 2.

Therefore, the discharge opening sealing member 2 and the communication port sealing member 5 are not interrelated with each other during the resealing of the discharge opening 1*a*, so that the discharge opening sealing member 2 can seal the discharge opening 1*a* with reliability.

Further, in this embodiment, during the unsealing of the discharge opening 1*a*, compared with the case where the two openings are unsealed at the same time, the two openings are unsealed with a difference in time. For this reason, a force required for unsealing each of the openings is small. Therefore, when the user unseals the openings, the unsealing operation becomes easy and it becomes possible to use a motor with a small unsealing force when the openings are unsealed by using the motor.

(Verification Experiment of Effect of Constitution of the Present Invention)

In order to confirm the effect of the developer supply container 1 in the present invention as described above, a comparative experiment for comparing the developer supply container of the present invention with that of Comparative Embodiment was conducted.

In this experiment, the developer supply container 1 which had a longitudinal length of about 500 mm, an inner diameter of the cylindrical portion 1B of about 30 mm, an inner diameter of the accommodating portion 1C of 72 mm, and an inner diameter of the buffer portion 1D of 57 mm and which was filled with about 750 g of a one-component developer.

Figure 9:
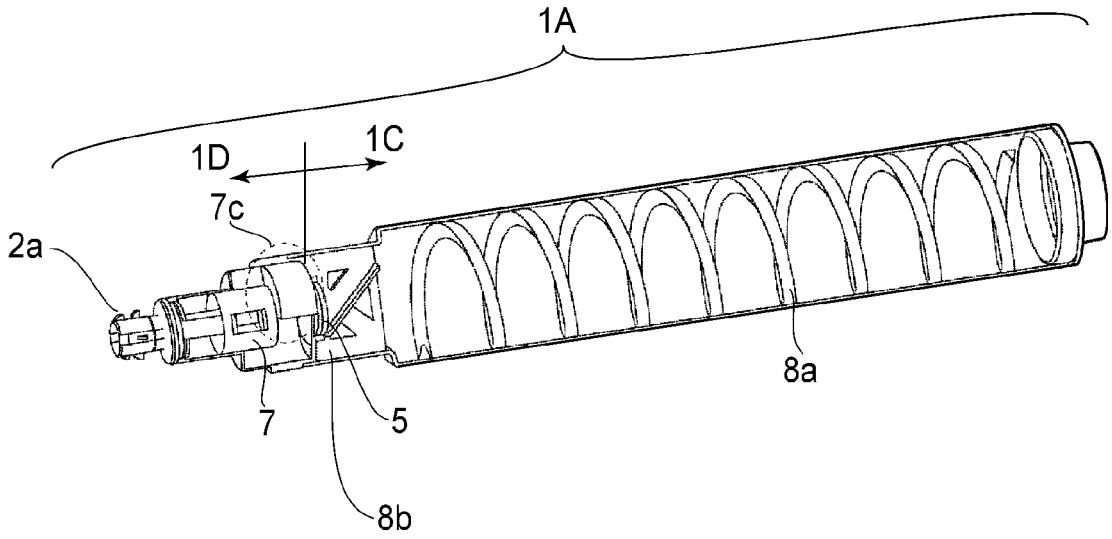
FIG. 9 is a partially perspective sectional view of a developer supply container according to Embodiment 3.
Figure 16:
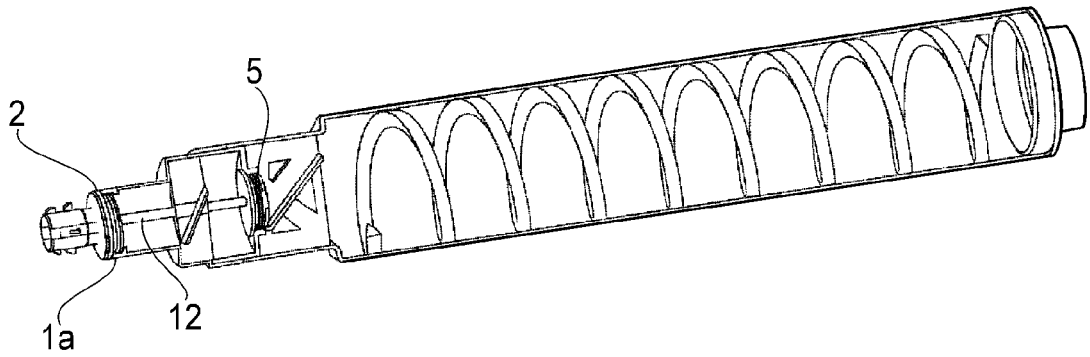
FIG. 16 is a partially perspective sectional view showing a developer supply container in Comparative Embodiment.

As the container constitution, the developer supply containers 1 having the shapes described in Embodiment 1 (FIG. 3), Embodiment 2 (FIGS. 8(*a*) to 8(*c*)), Embodiment 3 (FIG. 9) and Embodiment 4 (FIGS. 14(*a*) to 14(*d*)) were used. In Comparative Embodiment, as the container constitution, the developer supply container 1 having a shape shown in FIG. 16 was used.

In Comparative Embodiment, the discharge opening sealing member 2 and the communication port sealing member 5 are constituted integrally by a connecting member 12. As a result, during the unsealing of the discharge opening 1*a* and during sealing of the discharge opening 1*a* by the discharge opening sealing member 2, the discharge opening sealing member 2 and the communication port sealing member 5 are always moved in interrelation with each other. Incidentally, other constitutions are identical to those in Embodiment 1.

(Confirmation Experiment of Sealing Performance)

After the developer was filled in the developer supply container 1, the developer supply container 1 was actually set in the image forming apparatus and was rotated with a predetermined number of rotation (30 rpm) to discharge the developer therefrom. Thereafter, at the time when about 300 g of the developer was discharged, the rotation of the developer supply container 1 was stopped and was demounted from the image forming apparatus. A sealing state of the discharge opening 1*a* by the discharge opening sealing member 2 was observed.

As a result, the developer supply containers 1 having the shapes described in Embodiments 1, 2, 3 and 4 according to the present invention were confirmed that the discharge opening 1*a* was completely sealed by the discharge opening sealing member 2.

On the other hand, with respect to the developer supply container 1 used as Comparative Embodiment, the discharge opening sealing member 2 was a state in which the discharge opening sealing member 2 was somewhat detached from the discharge opening 1*a*, so that the developer supply container 1 was confirmed that the discharge opening 1*a* was not completely sealed by the discharge opening sealing member 2. When the developer supply container 1 was demounted from the image forming apparatus main assembly in the state in which the discharge opening 1*a* was not (completely) sealed, the developer scattered in the image forming apparatus main assembly or a floor in the neighborhood of the image forming apparatus main assembly, thus contaminating the apparatus main assembly or the floor.

In Comparative Embodiment, the discharge opening sealing member 2 and the communication port sealing member 5 are integrally connected by the connecting member 12, so that they are always moved in interrelation with each other when the openings are unsealed or sealed. For that reason, when the developer supply container 1 is demounted during the discharging of the developer, in interrelation with the movement of the discharge opening sealing member 2 to its associated sealing position, the communication port sealing member 5 integrally connected with the discharge opening sealing member 2 is also moved toward its associated sealing position. However, the developer is interposed within the developer supply container 1 and therefore when the communication port sealing member 5 is moved toward its associated sealing position, the movement of the communication port sealing member 5 is prevented by the interposed developer and therefore the communication port sealing member 5 cannot move to its associated sealing position. Correspondingly, the discharge opening sealing member 2 caused the improper sealing of the discharge opening 1*a*.

On the other hand, in the constitutions of Embodiments 1, 3 and 4, when the discharge opening sealing member 2 is moved to its associated sealing position, the contact surfaces at which the discharge opening sealing member 2 and the communication port sealing member 5 are connected are moved apart from each other. Further, in the constitutions of Embodiments 2 and 4, when the discharge opening sealing member 2 is moved to its associated sealing position, the flexible member 11 for connecting the discharge opening sealing member 2 and the communication port sealing member 5 is placed in the bent state. As a result, in Embodiments of the present invention, when the discharge opening sealing member 2 is moved to its associated sealing position, the communication port sealing member 5 is configured so as not to be interrelated with the discharge opening sealing member 2 and so as not to be moved together with the discharge opening sealing member 2. Therefore, by the constitutions of Embodiments 1, 3 and 4, the discharge opening sealing member 2 and the communication port sealing member 5 are not interrelated with each other during the sealing (resealing) of the discharge opening 1*a*, so that the discharge opening 1*a* can be sealed by the discharge opening sealing member 2 with reliability.

Further, in Embodiment 2 (FIGS. 8(*a*) to (*c*)), compared with Embodiment 1 (FIG. 3), in the buffer portion 1D, the flexible connecting member 11 for connecting the discharge opening sealing member 2 and the communication port sealing member 5 is provided in place of the connecting members 6 and 7 used in Embodiment 1. As a result, there is no need to provide the connecting members 6 and 7 having the contact surfaces as provided in Embodiment 1, so that the constitute of Embodiment 2 is simple. As a result, the number of parts is decreased, thus leading to cost reduction.

Further, in Embodiment 3 (FIG. 9), compared with Embodiment 1 (FIG. 3), the connecting member 7 provided integrally with the communication port sealing member 5 in the buffer portion 1D is provided with the feeding portion 7*c*. As a result, there is no need to provide the developer feeding portion 8*c* provided to the buffer portion 1D as in Embodiment 1, so that the number of parts is decreased by the constitution of Embodiment 3 and thus the productivity is improved.

Further, in Embodiment 4 (FIGS. 14(*a*) to 14(*d*)), compared with Embodiment 2 (FIGS. 8(*a*) to 8(*c*)), before the start of the use of the container, the flexible connecting member 11 provided in the buffer portion 1D in Embodiment 2 connects the discharge opening sealing member 2 and the communication port sealing member 5 in the bent state. As a result, in Embodiment 4, compared with the case of simultaneously unsealing the two openings, the two openings are unsealed in the order of the discharge opening 1*a* associated with the discharge opening sealing member 2 and the communication port 4 associated with the communication port sealing member 5. For this reason, the force required for unsealing the opening is small.

In the container constitution in the above-described developer supply containers 1, an unsealing strength of the discharge opening 1*a* is set at about 30N and that of the communication port 4 with the communication port sealing member 5 is set at about 30N. As a result, when the two openings are unsealed, the unsealing force (strength) of about 60N is required at the maximum. On the other hand, in Embodiment 4, unsealing timing for the discharge opening 1*a* is deviated from that for the communication port 4, so that the required maximum unsealing force can be reduced to about 30N. Therefore, it was confirmed that the force required for unsealing the opening is small. As a result, the unsealing operation becomes easy during the unsealing by the user, and the motor with the small unsealing force can be used during the unsealing by the motor.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 321638/2008 filed Dec. 17, 2008, which is hereby incorporated by reference.

What is claimed is:

1. A developer supply container detachably mountable to an image forming apparatus, comprising:

a first chamber, provided with a first opening, for accommodating a developer;

a second chamber for receiving the developer from said first chamber through the first opening, said second chamber being provided with a second opening for permitting discharge of the developer to an outside of said developer supply container;

a first sealing member for sealing the first opening;

a second sealing member for sealing the second opening; and a connecting mechanism for interrelating an unsealing operation of the first opening with an unsealing operation of the second opening, while permitting a resealing operation of the second opening by said second sealing member without resealing the first opening by said first sealing member.

2. A container according to claim 1, wherein said connecting mechanism includes a first engaging portion provided to said first sealing member and a second engaging portion provided to said second sealing member, wherein the first engaging portion and the second engaging portion are in a relationship in which they are engageable with each other so that said first sealing member and said second sealing member integrally move relative to the first opening and the second opening during the sealing operations of the first and second openings, and wherein the first engaging portion and the second engaging portion are in a relationship in which they are slidable toward a resealing direction of the second opening by said second sealing member during the resealing operation of the second opening by said second sealing member.

3. A container according to claim 2, wherein the first engaging portion is provided with a slot hole extending in an unsealing direction of the first opening, and the second engaging portion includes an abutting portion capable of being abutted against a contact surface which is defined by the hole of the first engaging portion and is close to said second sealing member with respect to the unsealing direction.

4. A container according to claim 2, wherein the first engaging portion is provided with a hole and the second engaging portion includes an extended portion extending toward said first sealing member so as to pass through the hole, and wherein the extended portion includes, at its end portion, an abutting portion capable of being abutted against a contact surface formed movably in a direction in which the contact surface is more distant from said second sealing member than the hole of the first engaging portion.

5. A container according to claim 2, wherein the first engaging portion includes an extended portion extending toward said second sealing member and the second engaging portion is provided with a hole provided so as to permit passing of the extended portion through the hole, and wherein the extended portion includes, at its end, an abutting portion capable of being abutted against a contact surface formed movably in a direction in which the contact surface is more distant from said first sealing member than the hole of the second engaging portion.

6. A container according to claim 1, wherein said connecting mechanism is a flexible member for connecting said first sealing member and said second sealing member.

7. A container according to claim 6, wherein the flexible member has a string like shape.

8. A container according to claim 1, wherein said second sealing member includes a locking portion engageable with a locking member of the image forming apparatus, and wherein the locking portion is configured tee to receive from the locking member a force for integrally moving said first sealing member and said second sealing member in an unsealing direction relative to the first opening and the second opening and is configured to receive from the locking member a force for moving said second sealing member in a resealing direction relative to the second opening.

9. A container according to claim 8, wherein the unsealing operation of the first opening and the unsealing operation of the second opening are interrelated with each other so that the first opening is unsealed after the second opening is unsealed.

10. A container according to claim 1, further comprising a first feeding portion for feeding the developer accommodated in said first chamber toward the first opening by rotation of said first chamber, a second feeding portion for feeding the develop received from said first chamber toward the second opening by rotation of said second chamber, and a coupling portion for receiving a rotational force for integrally rotating said first chamber and said second chamber from a driving member of the image forming apparatus.

11. A container according to claim 10, wherein the second feeding portion includes a feeding pipe for feeding the developer by the rotation of said second chamber.

12. A developer supply container detachably mountable to an image forming apparatus including a locking member, said developer supply container comprising:

a first chamber, provided with a first opening, for accommodating a developer;

a second chamber for receiving the developer from said first chamber through the first opening, said second chamber being provided with a second opening for permitting discharge of the developer to an outside of said developer supply container;

a first sealing member for sealing the first opening;

a second sealing member for sealing the second opening;

a locking portion, provided engageably with the locking member, for receiving from the locking member a force for unsealing the second opening; and an interrelating mechanism for interrelating an unsealing operation of the first opening with an unsealing operation of the second opening performed by the force received by said locking portion, wherein said interrelating mechanism interrelating the unsealing operations of the first and second openings with each other so that the first opening is unsealed after the second opening is unsealed.

13. A developer supply container detachably mountable to an image forming apparatus including a locking member, said developer supply container comprising:

a first chamber, provided with a first opening, for accommodating a developer;

a second chamber for receiving the developer from said first chamber through the first opening wherein said second chamber is provided with a second opening for permitting discharge of the developer to an outside of said developer supply container;

a feeding pipe for feeding the developer toward the second opening by rotation of said second chamber;

a first sealing member for sealing the first opening so that the developer does not enter the feeding pipe; and a second sealing member for sealing the second opening, said second sealing member being capable of resealing the second opening without resealing the first opening by said first sealing member.

14. A container according to claim 13, further comprising a feeding portion for feeding the developer accommodated in said first chamber toward the first opening by rotation of said first chamber, and a coupling portion for receiving a rotational force for integrally rotating said first chamber and said second chamber from a driving member of the image forming apparatus.

* * * * *